US011065753B2

(12) United States Patent
Danielsson et al.

(10) Patent No.: US 11,065,753 B2
(45) Date of Patent: Jul. 20, 2021

(54) LOAD-BASED CONTROL OF BREAKER MACHINE

(71) Applicant: ATLAS COPCO AIRPOWER, NAAMLOZE VENNOOTSCHAP, Wilrijk (BE)

(72) Inventors: Torkel Danielsson, Nybro (SE); Magnus Karlsson, Ljungbyholm (SE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 147 days.

(21) Appl. No.: 16/077,204

(22) PCT Filed: Feb. 6, 2017

(86) PCT No.: PCT/SE2017/050101

§ 371 (c)(1),
(2) Date: Aug. 10, 2018

(87) PCT Pub. No.: WO2017/142456

PCT Pub. Date: Aug. 24, 2017

(65) Prior Publication Data

US 2019/0022846 A1 Jan. 24, 2019

(30) Foreign Application Priority Data

Feb. 16, 2016 (SE) ..... 1650206-4

(51) Int. Cl.
*B25D 11/00* (2006.01)
*B25D 11/04* (2006.01)

(52) U.S. Cl.
CPC ..... *B25D 11/04* (2013.01); *B25D 11/00* (2013.01); *B25D 2250/201* (2013.01); *B25D 2250/221* (2013.01)

(58) Field of Classification Search
CPC ..... B25D 9/26; B25D 11/005
See application file for complete search history.

(56) References Cited

U.S. PATENT DOCUMENTS 3,994,592 A * 11/1976 Lardon ..... G01J 3/433 356/407
4,314,451 A * 2/1982 Leeds ..... A23B 4/066 62/136

(Continued)

FOREIGN PATENT DOCUMENTS

DE 10358571 7/2005
DE 102011080374 A1 2/2013

(Continued)

OTHER PUBLICATIONS

International Search Report dated Apr. 24, 2017 on PCT/SE2017/050101.

*Primary Examiner* — Andrew M Tecco
*Assistant Examiner* — Eyamindae C Jallow
(74) *Attorney, Agent, or Firm* — Bacon & Thomas, PLLC

(57) ABSTRACT

A breaker machine includes a power source, a tool holder arranged to receive a tool and a power driven striking mechanism arranged to strike a tip of the tool with a striking frequency on a hard surface. The breaker machine further includes control circuitry arranged to control an output from the power source and load detection means arranged to detect the load of the power source and transmit information relating to the detected load of the power source to the control circuitry. The control circuitry is arranged to receive information relating to a load of the power source, select a striking frequency based on the information relating to the load of the power source and to apply the selected striking frequency by ramping a current striking frequency to the (Continued)

selected striking frequency based on a predetermined ramping scheme by controlling the output from the power source.

9 Claims, 4 Drawing Sheets

(56) References Cited

U.S. PATENT DOCUMENTS

| | | | | |
|---|---|---|---|---|
| 8,272,452 | B2 * | 9/2012 | Katou | B25D 11/005 173/176 |
| 8,505,647 | B2 * | 8/2013 | Kasuya | B25D 11/005 173/11 |
| 9,321,155 | B2 * | 4/2016 | Eshleman | H01H 9/06 |
| 9,321,164 | B2 * | 4/2016 | Onoda | B25D 16/00 |
| 9,475,180 | B2 * | 10/2016 | Eshleman | B25B 21/00 |
| 10,160,049 | B2 * | 12/2018 | Eshleman | B25F 5/00 |
| 10,556,333 | B2 | 2/2020 | Wirnitzer et al. | |
| 2004/0144551 | A1 * | 7/2004 | Koskimaki | B25D 9/18 173/1 |
| 2004/0200628 | A1 | 10/2004 | Schmitzer | |
| 2005/0161241 | A1 * | 7/2005 | Frauhammer | B25F 5/00 173/1 |
| 2006/0196683 | A1 * | 9/2006 | Meixner | B25D 9/26 173/2 |
| 2009/0295313 | A1 * | 12/2009 | Suzuki | H02H 7/1213 318/139 |
| 2011/0024146 | A1 * | 2/2011 | Katou | B25D 11/005 173/15 |
| 2011/0098867 | A1 * | 4/2011 | Jonsson | G06F 1/3209 700/295 |
| 2011/0114347 | A1 * | 5/2011 | Kasuya | B25D 11/005 173/11 |
| 2011/0273117 | A1 * | 11/2011 | Nakamura | B23D 51/16 318/139 |
| 2013/0186661 | A1 | 7/2013 | Okubo | |
| 2016/0129576 | A1 | 5/2016 | Nishikawa et al. | |
| 2016/0279776 | A1 * | 9/2016 | Wirnitzer | B25F 5/00 |

FOREIGN PATENT DOCUMENTS

| | | |
|---|---|---|
| DE | 102013224759 | 6/2015 |
| EP | 0107629 | 5/1984 |
| WO | 2010087206 | 8/2010 |
| WO | 2013139425 A1 | 9/2013 |
| WO | 2014192477 | 12/2014 |

* cited by examiner

LOAD-BASED CONTROL OF BREAKER MACHINE

TECHNICAL FIELD

The present invention relates to machines for breaking of asphalt, concrete or similar.

BACKGROUND OF THE INVENTION

A common way of breaking asphalt, concrete or similar is to use a machine, e.g., a handheld machine that strikes the asphalt, concrete or similar with the tip of a tool mounted on, or integrated in, the handheld machine. Such machines are often referred to as breaker machines. The strike of the tip of the tool against a hard object may cause a slip of the tip against the surface it is supposed to strike. The slipping is problematic in that it implies a work situation that may become difficult to control and inefficient. A further problem caused by slipping is the potential to cause injuries.

In order to diminish the problem of slipping, a typical operation of a breaker machine for breaking concrete, asphalt or similar typically starts with a low striking frequency in order for the operator to be able to better fix the tool against the surface on which it operates. The striking frequency is then increased to a typical operating frequency for breaking concrete, asphalt or similar.

For instance, a breaker machine using a combustion engine, typically idling below 10 Hz, is gradually provided more gas, e.g. via a gas regulator on a handle of the handheld breaker machine, until the striking frequency increases to about 20 Hz.

If the breaker machine instead uses an electric motor during operation, a first known strategy is to mimic the solution provided by the combustion engine by providing the electric motor with an idling speed, wherein speed may be measured in revolutions per minute, RPM, and providing the handheld breaker machine with a regulator adapted to regulate the speed of the electric motor to fall within the idling speed and a maximum speed of the electric motor.

Another known strategy is to run the electric motor at full throttle all the time, i.e. no idling. During the initial phase of breaking the asphalt, concrete or similar, the speed of the motor drops slightly due to increased resistance, only to rapidly approach the default maximum speed. By using this strategy, the number of components needed to build the breaker machine can be reduced, since components associated with providing the electric motor with an idling speed and the regulator adapted to regulate the speed of the electric motor can be removed. However, it also enhances the problems associated with the potential for the tip to slip.

An additional problem associated with repeated use of handheld breaker machines that strikes asphalt, concrete or similar as a way of breaking them is the vibrations experienced by the operator of the handheld breaker machine. Over time, vibrations stemming from shock associated with the tip of the tool striking the asphalt, concrete or similar may lead to repetitive strain injuries. A lack of a smooth transition to the typical operating frequency for breaking concrete, asphalt or similar, as in the second strategy above, may aggravate the problem further.

DE102011080374 relates to the problem of obtaining an advantageous contact pressure between a handheld electrical machine and a surface in contact with the handheld electrical machine, wherein "advantageous" may be with respect to an efficient processing progress and/or a vibration and/or wear-resistant and/or energy saving processing. The document discloses a handheld electrical machine that directly, via a pressure sensor, and/or indirectly, via a vibration-sensitive spring arrangement, determines a pressure against the handheld electrical machine. DE102011080374 is primarily aimed at machines like electrical drills or chisels, where the vibrations are much smaller in magnitude compared to the vibrations of a breaker machine. The advantageous contact pressure relates to a more or less constant contact between the electrical machine and the surface, rather than the more pronounced repeated striking of the surface by breaker machines.

Operating breaker machines gives rise to unique problems associated with the repetitive hard strikes against a surface. The resulting shock of a strike differs from the much lighter vibrations of ordinary electrical drills and chisels. There is thus a need in the art to improve the way breaker machines strikes solid surfaces in attempt to break the surfaces.

SUMMARY OF THE INVENTION

An object of the present disclosure is to provide breaker machines, methods and computer programs to mitigate or at least alleviate some of the above identified problems.

The disclosure proposes a breaker machine comprising a power source, a tool holder arranged to receive a tool and a power driven striking mechanism arranged to strike a tip of the tool with a striking frequency on a hard surface. The breaker machine further comprises control circuitry arranged to control the power source and load detection means arranged to detect the load of the power source and transmit information relating to the detected load of the power source to the control circuitry. The control circuitry is arranged to receive the information relating to a load of the power source. The control circuitry is further arranged to select a striking frequency based on the information relating to the load of the power source and to apply the selected striking frequency by ramping a current striking frequency to the selected striking frequency based on a predetermined ramping scheme by controlling the output from the power source.

During operational use, the disclosed breaker machine automatically changes the striking frequency to meet the needs of the situation by adjusting the striking frequency. This greatly reduces the risk of having the tip of the tool slipping as it strikes the hard surface. The breaker machine therefore becomes easier to use and reduces the risk of injury. The breaker machine also reduces the operator's exposure to sound and vibrations, thereby reducing the risk of repetitive strain injuries. A further advantage is that the need for a manual regulator of striking frequency is eliminated. Components relating to such a manual regulator, e.g. cables and wires that need to be connected to the power source can be removed, resulting in a design that is cheaper to produce. An additional advantage of eliminating the need for a manual regulator is that the removed components associated with the manual regulator were potential sources for risks relating to faulty connections between the manual regulator and the power source. By using a ramping scheme, the skill of the operator becomes less important. A ramping scheme may further perform adjustments of the output from the power source that are too subtle to be performed manually, thereby reducing the risk of slippage, as well as reducing the operators exposure to sound and vibrations. The disclosed breaker machine is thus also safer with respect to potential malfunctions.

According to an aspect, the power source comprises an electric motor. Electric motors typically have programmable control circuitry. An electric motor having programmable control circuitry requires few, if any, extra components to obtain information relating to the load of the electric motor. The electric motor may in itself be used as a sensor when determining the information relating to the load of the power source. This facilitates breaker machines that are more inexpensive to manufacture than those of the prior art. Additionally, an electric motor is typically more energy efficient compared to hydraulic power sources or combustion engine power sources.

According to an aspect, the predetermined ramping scheme comprises at least two different ramping rates. By ramping at different inclinations, the operator's control over the breaker machine increases, which means that the operator will experience the breaker machine as easy to manoeuvre.

According to an aspect, the control circuitry is programmable. A programmable control circuitry facilitates upgrades and changes in ramping schemes. In particular, the different ramping schemes for different tools and/or different surfaces may be implemented.

According to an aspect, the breaker machine further comprises load detection means arranged to detect the load of the power source and transmit information relating to the load of the power source to the control circuitry. The load detection means provides the control circuitry with information relating to the load of the power source, which facilitates the selection of a striking frequency by the control circuitry.

According to an aspect, the load detection means comprises a power analyser arranged to determine an input power to the power source. A power analyser enables a direct determination of input power, which provides a very accurate measure of input power.

According to an aspect, the load detection means comprises a multi-meter arranged to measure an input voltage, an input electric current and an efficiency measure of the power source separately. A multi-meter enables indirect determination of input power. The multi-meter usually requires few additional components, which makes it a cheap and energy efficient solution. If an electric motor is used as a power source, the input voltage and input electric current can typically be provided by the electric motor.

According to an aspect, the breaker machine comprises storage means having stored thereon information relating to a predetermined measure of a highest mechanical output power of the power source. The need to estimate the highest mechanical output power is eliminated, which reduces the need for computational resources, as well as the total power consumption.

According to an aspect, the breaker machine is arranged to determine a load of the power source based on information relating to an input power to the power source and information relating to a predetermined measure of a highest mechanical output power of the power source.

The input power is easy to determine and the measure of the highest mechanical output power may be determined before operational use of the breaker machine. This measure of load is thus fast, requires minimal extra power consumption and is easy to implement.

The disclosure also proposes a method, performed in a control circuitry of a breaker machine. The breaker machine comprises a power source, a tool holder arranged to receive a tool and a power driven striking mechanism arranged to strike a tip of the tool with a striking frequency on a hard surface. The breaker machine further comprises control circuitry arranged to control the power source. The control circuitry is arranged to receive information relating to a load of the power source and that the control circuitry is further arranged to select a striking frequency based on the information relating to the load of the power source and to apply the selected striking frequency by controlling an output from the power source. The method comprises the steps of receiving information relating to a load of the power source, selecting a striking frequency based on the information relating to the load of the power source, and applying the selected striking frequency by ramping a current striking frequency to the selected striking frequency based on a predetermined ramping scheme for controlling an output from the power source.

The disclosure also proposes a computer program comprising computer program code which, when executed, causes a control circuitry of a breaker machine according to the present disclosure to carry out a method according to the present disclosure. The computer program has all the advantages associated with the disclosed breaker machine above.

DETAILED DESCRIPTION OF THE INVENTION

Figure 1:
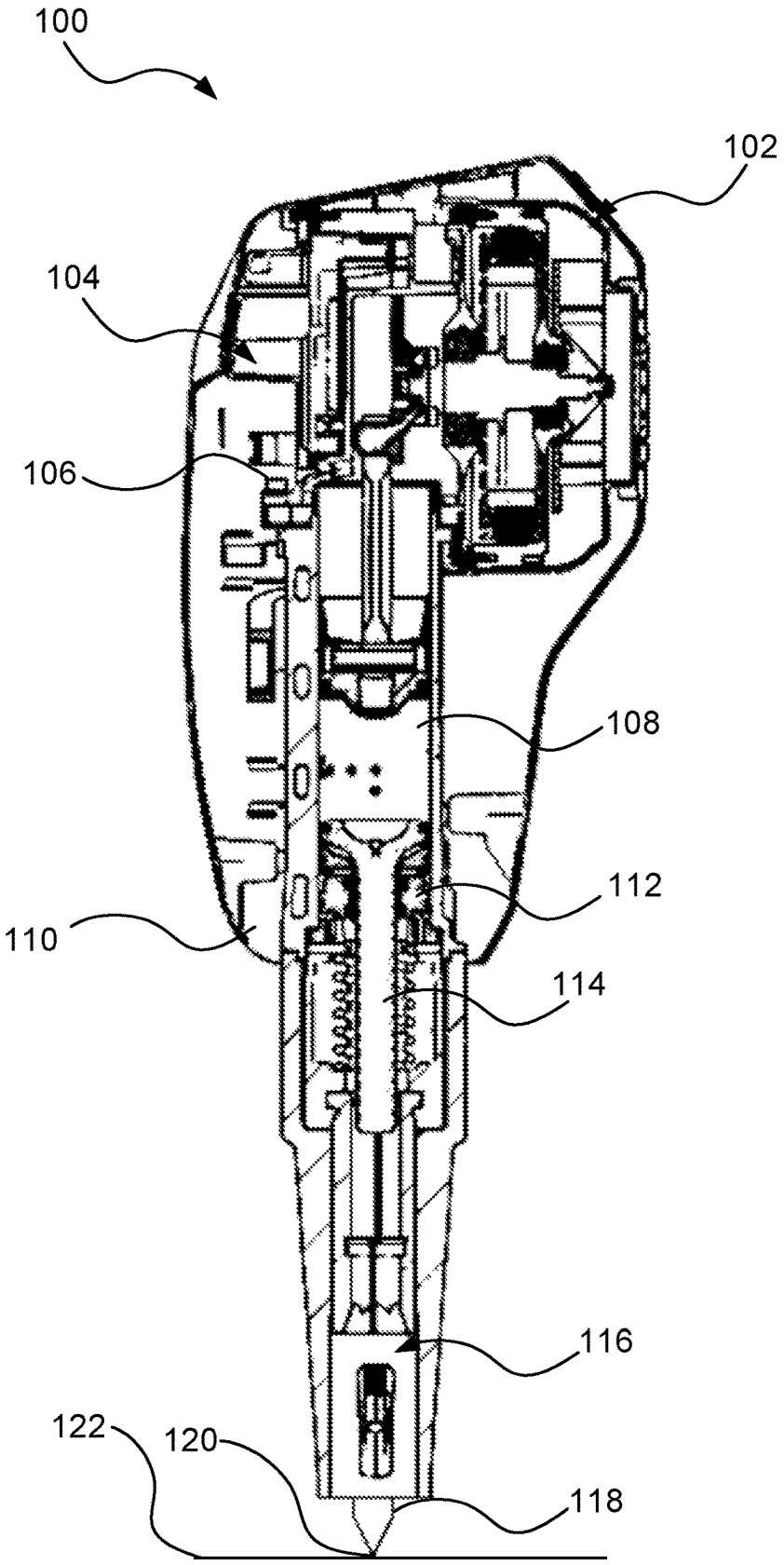
FIG. 1 illustrates a cross section of a handheld breaker machine.

FIG. 1 illustrates a cross section of a handheld breaker machine 100 and general operating principles of such a breaker machine. The handheld breaker machine 100 comprises an electric motor 102 and control circuitry 104. The handheld breaker machine 100 further comprises a striking mechanism, the striking mechanism comprising a crank 106, a drive piston 108, a start cavity 110, a strike cylinder 112 and a strike piston 114. The handheld breaker machine 100 also comprises a tool holder 116 arranged to mount a tool 118. The operating principles presented in the following disclosure apply to handheld breaker machines 100 with or without a tool 118 mounted in the tool holder 116. FIG. 1 discloses the handheld breaker machine 100 with a tool 118 mounted in the tool holder 116 in order to facilitate understanding of the technical effects and advantages associated with the invention disclosed herein.

The striking mechanism is arranged to operate as follows. The crank 106 is arranged to be driven by the electric motor 102. The crank is further arranged, when driven by the electric motor 102, to move the drive piston 108 back and forth towards the strike piston 114. When the drive piston 108 is moved towards the strike piston 114, air trapped between the drive piston 108 and the strike piston 114 exerts pressure on the strike piston 114, wherein the strike piston 114 is arranged to strike the tool 118 in the tool holder 116 in response to the exerted pressure. Air will only be trapped between the drive piston 108 and the strike piston 114 if the start cavity 110 is blocked.

The strike cylinder 112 is suspended by a spring and is arranged to be moved into a blocking position, wherein the strike cylinder 112 blocks the start cavity 110, thereby initiating the strike process. In particular, the strike cylinder is arranged to, in response to pressing the tip 120 of the mounted tool 118 against a surface 122, e.g. using handles (not shown) of the handheld breaker machine 100, move the strike cylinder 112 into said blocking position.

Handling of the handheld breaker machine 100, which has a typical weight of about 25 kg, requires great care in order to avoid slipping with the tip 120 of the tool 118 when striking the surface 122. The handheld breaker machine 100 is arranged to idle at a striking frequency below 10 Hz. A low initial striking frequency enables an operator to reduce the risk of slipping with the tip 120. As the surface 122 starts to break, the risk of slipping is reduced and a higher striking frequency is enabled. The handheld breaker machine 100 is further arranged to increase the striking frequency above the idle striking frequency via a manual regulator (not shown) arranged on the handles (not shown) of the handheld breaker machine 100. A skilled operator may then increase the striking frequency, e.g. up to 20 Hz, by carefully adjusting the manual regulator.

Figure 2:
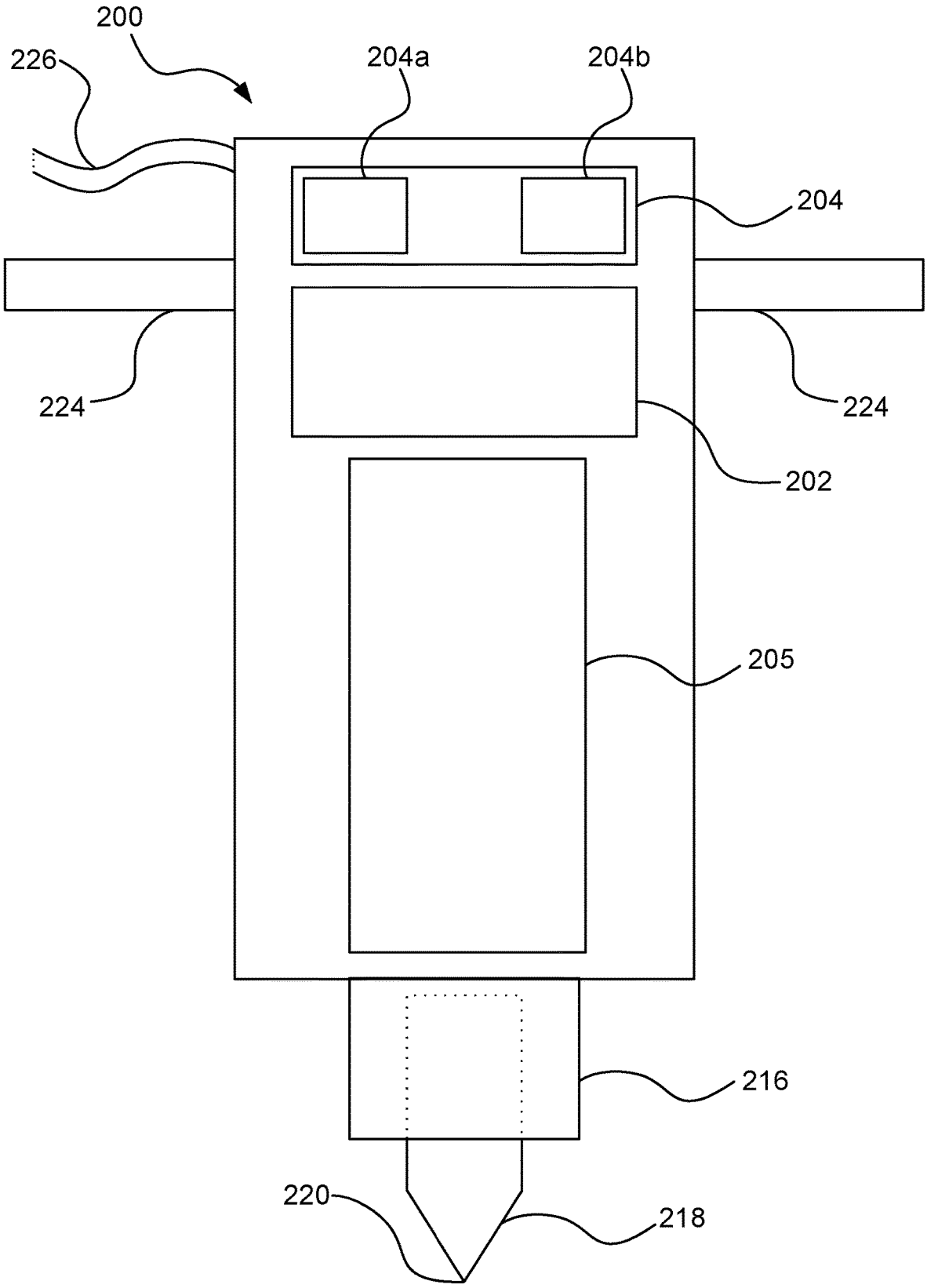
FIG. 2 schematically illustrates a breaker machine according to the present disclosure.

FIG. 2 schematically discloses a breaker machine 200 according to the present disclosure. The breaker machine 200 comprises a power source 202. The breaker machine 200 also comprises a tool holder 216 arranged to receive a tool 218. The breaker machine 200 further comprises a power driven striking mechanism 205 arranged to strike a tip 220 of the tool 218 with a striking frequency on a hard surface. The power source 202 is arranged to drive the power driven striking mechanism 205. The breaker machine 200 additionally comprises control circuitry 204 arranged to control the power source 202. The control circuitry 204 is arranged to receive information relating to a load of the power source 202. The control circuitry 204 is further arranged to select a striking frequency based on the information relating to the load of the power source 202 and to apply the selected striking frequency by controlling an output from the power source 202.

The general principles of a power source driving a power driven striking mechanism have been described in relation to FIG. 1, above. The power source 202 may comprise e.g. an electric motor, a combustion engine, a pneumatic power source (such as an air compressor) or a hydraulic power source. Machine breakers comprising an electric motor will be described below to further illustrate the disclosed invention, though the principles of how to determine information relating to the load of the power source apply to all aspects of the disclosed invention.

The main purpose of the electric motor is to convert electric input power to mechanical output power. The breaker machine preferable comprises an electric power interface 226, e.g. an electric cable, arranged to provide the electric motor 202 with electric power from an external electric power source (not shown). Another alternative is having the breaker machine 200 comprising a battery (not shown), the battery being arranged to provide electric power to the electric motor 202.

In order for the electric motor 202 to run at a certain speed, i.e. the breaker machine 200 operating at a certain striking frequency, the electric motor needs to overcome mechanical resistance associated with the tool 218 striking the surface. The mechanical output power from the electric motor is what is used to overcome the mechanical resistance. Load is related to what is required by the electric motor 202 to overcome the mechanical resistance. There are several ways load can be defined, which in turn means that there are several ways to measure load. One definition of load is torque output at a corresponding speed of the electric motor, wherein speed is a measure of rotational speed, e.g., revolutions per minute, RPM. When the electric motor 202 converts electric input power to mechanical output power, some of the electric input power is lost. The power conversion efficiency typically varies based on the load. Load may also be defined as the ratio of the input power and a maximum power rating. The maximum power rating is a highest input power allowed to flow through the electric motor 202. Typically, the maximum power rating is a highest mechanical output power that can be safely output from the electric motor 202. The maximum power rating being a highest mechanical output power that can be safely output from the electric motor 202 is a common definition in the context of electric motors. The safety criterion is usually determined at the time the electric motor 202 is manufactured, and is set such that the electric motor 202 is not subjected to unnecessary stress.

A load, defined as the ratio of the current input power and the highest mechanical output power that can be safely output from the electric motor 202, may then be determined by determining the input power, the highest mechanical output power and subsequently the ratio between the two. Using this definition of load, various embodiments of the disclosed breaker machine 202 will be discussed below, wherein different ways of determining information relating to the load will be disclosed and related advantages pointed out. First, different ways of determining input power are disclosed.

According to an aspect, the breaker machine 200 further comprises load detection means arranged to detect the load of the power source 202 and transmit information relating to the load of the power source 202 to the control circuitry 204. A power analyser comprised in the load detection means and arranged to determine the input power to the power source 202 enables direct measurement of the input power. The input power may also be determined based on a voltage, an electric current and an efficiency measure of the electric motor 202.

According to another aspect, the load detection means comprises a multi-meter arranged to measure the voltage, the electric current and the efficiency measure separately. As an example, the voltage and electric current are based on a root mean square, RMS, voltage and electric current, respectively. According to a yet further aspect, the efficiency measure is based on a so-called power factor.

Different aspects relating to the highest mechanical output power is disclosed below. As an example, the highest mechanical output power is based on a highest mechanical output power that can be safely output from the electric motor 202 and an efficiency measure of the electric motor 202 under conditions present during output of the highest mechanical output power that can be safely output from the electric motor 202. A direct measure of the efficiency measure is determined based on varying mechanical resistance and motor speed, and comparing the resulting output mechanical power with a corresponding input power. The efficiency measure may also be determined indirectly based on a comparison between utilized electric input current and electric input current, wherein utilized electric input current is based on a difference between electric input current and an estimate of electric current losses of the electric input current. The highest mechanical output power is preferably determined at a factory during manufacture of the electric motor 202. By having the highest mechanical output power being determined before operational use of the electric motor 202 in the breaker machine 200, the need for measurements to determine the highest mechanical output power during operational use can be eliminated. Instead, information relating to the highest mechanical output power, e.g. a highest mechanical output power that can be safely output from the electric motor 202 and an efficiency measure of the electric motor 202 under conditions present during output of the highest mechanical output power that can be safely output from the electric motor 202, can be stored in the breaker machine 200. According to an aspect, the control circuitry comprises storage means 204*b* arranged to store the information relating to the highest mechanical output power.

To summarize, the load may be determined based on a ratio of the electric input power to the highest mechanical output power. A general example of a breaker machine employing this solution is a breaker machine 200 which is arranged to determine a load of the power source based on information relating to an input power to the power source and information relating to a predetermined measure of a highest mechanical output power of the power source.

According to an aspect, the information relating to the highest mechanical output power is stored in dedicated storage means 204*b* having stored thereon information relating to a predetermined measure of a highest mechanical output power of the power source. The dedicated storage means 204*b* is preferably arranged to provide the information relating to a predetermined measure of a highest mechanical output power of the power source to the control circuitry 204. In one example, the control circuitry 204 is arranged retrieve the desired information from the storage means 204*b*. In another example, the storage means provides the control circuitry 204 with the information, i.e. the control circuitry 204 receives the information. The load can be determined using the information relating to both input power and the highest mechanical output power. In one example, the control circuitry 204 is arranged to determine a load of the power source 202 based on measured input power and the information relating to a predetermined measure of a highest mechanical output power of the power source 202. According to a further aspect, the control circuitry comprises a processor 204*a* arranged to determine the load of the power source 202 based on measured input power and the information relating to the predetermined measure of a highest mechanical output power of the power source 202.

The striking process is initiated by pressing the tip 220 of the mounted tool 218 against a surface, preferably using handles 224 when using a handheld breaker machine 200. When the tip of the tool strikes the surface, the electric motor will experience mechanical resistance, i.e. it will be subjected to a load. The mechanisms for determining a load has been described above. The striking frequency will correlate with a time-averaged load measure. A striking frequency that is too high, e.g., exceeds a predetermined threshold, will increase the risk of incurring a slip of the tip 220 of the tool 218 against the surface. By reducing the striking frequency, the risk may be reduced. Since the striking frequency is related to the load, the control circuitry 204 determines that the striking frequency is currently too high based on information relating to the load. The control circuitry 204 may then lower the load by sending the appropriate control signals to the electric motor 202.

In another example, the electric motor 202 is arranged to provide an idling striking frequency below 10 Hz. An operator will typically want to start out at a lower striking frequency until the tip 220 of the tool 218 has made enough of an impact on the surface to reduce the probability of slipping. The control circuitry 204 detects the improved steadiness based on the load and increases the striking frequency to approximately 20 Hz by increasing the mechanical output power of the electric motor 202.

According to an aspect, the control circuitry 204 is further arranged to apply the selected striking frequency based on ramping a current striking frequency to the selected striking frequency based on a predetermined ramping scheme. By employing a ramping scheme, the breaker machine 200 can automatically adjust to changes in load, without an operator having to do anything. The ramping scheme may be adjusted to reduce the risk of the tip 220 of the tool 218 slipping when striking the hard surface. According to an aspect, the predetermined ramping scheme comprises at least two different ramping rates. Different ramping rates enhance the operator's control over the breaker machine 200. Different ramping rates may also be used to adapt different circumstances.

Furthermore, certain tools and/or certain surfaces might exhibit unique characteristics, which are reflected in how they will affect the load. It may therefore be of interest to be able to adapt the breaker machine 200 such that it can employ different ramping schemes for different situations. According to an aspect, the control circuitry 204 is programmable. A programmable control circuitry 204 facilitates the use of different ramping schemes. According to a further aspect, the breaker machine 200 comprises storage means 204*b* having at least one predetermine ramping scheme stored thereon. According to a yet further aspect, the breaker machine 200 comprises an interface (not shown) arranged to enable an operator to select a predetermined ramping scheme stored on the storage means 204*b*. A programmable control circuitry 204 also facilitates software upgrades.

Figure 3:
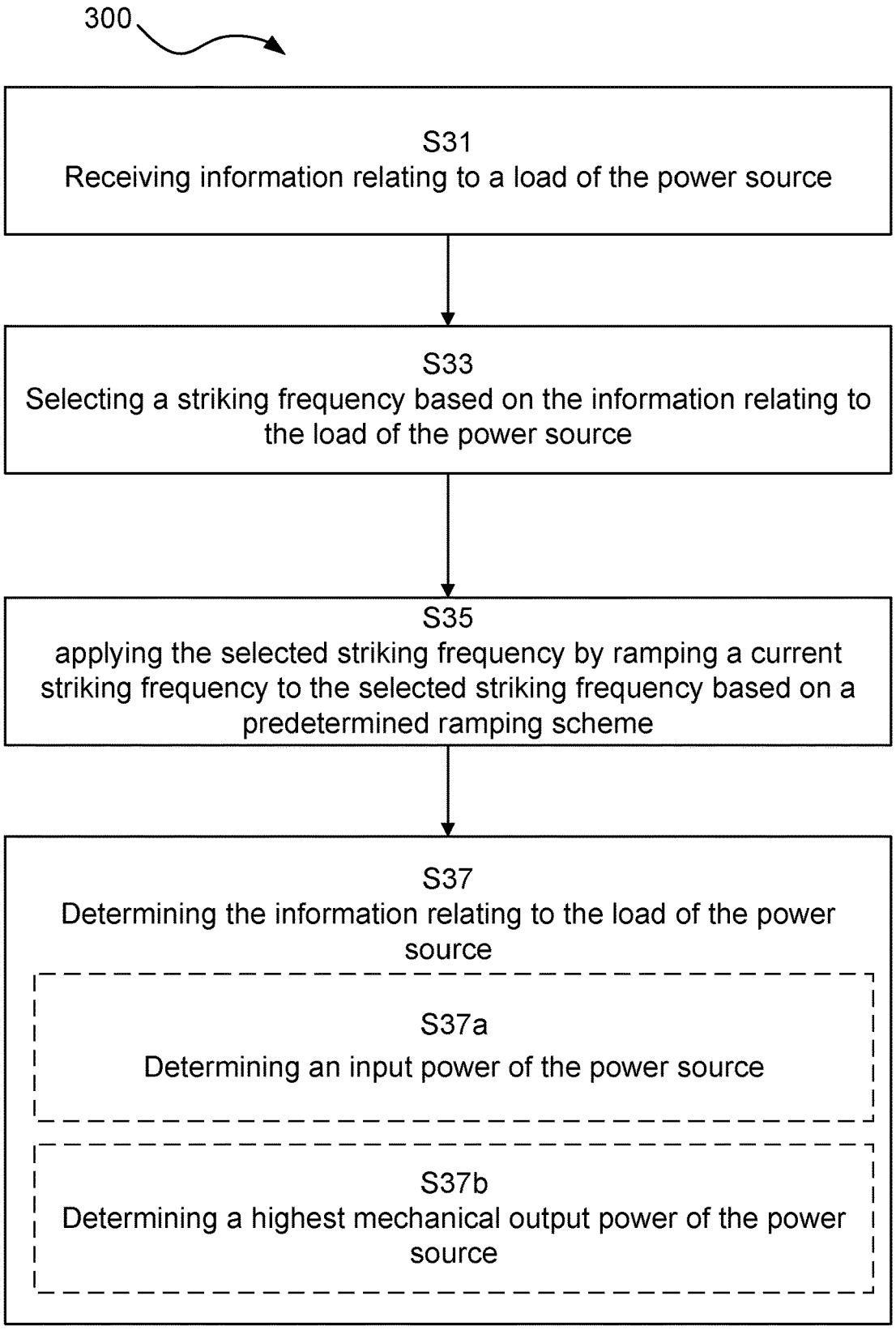
FIG. 3 illustrates example steps of a method performed in a breaker machine.

FIG. 3 illustrates method steps of a method 300 according to the present disclosure. The method 300 is performed in a control circuitry of a breaker machine. The breaker machine comprises a power source, a tool holder arranged to receive a tool and a power driven striking mechanism arranged to strike a tip of the tool with a striking frequency on a hard surface. The control circuitry is arranged to control the power source. The control circuitry further is arranged to receive or retrieve information relating to a load of the power source and arranged to select a striking frequency based on the information relating to the load of the power source. The control circuitry is also arranged apply the selected striking frequency by controlling an output from the power source. The method 300 comprises receiving S31 information relating to a load of the power source. The method 300 further comprises selecting S33 a striking frequency based on the information relating to the load of the power source, and applying S35 the selected striking frequency by ramping a current striking frequency to the selected striking frequency based on a predetermined ramping scheme.

As has been discussed in relation to FIG. 2 above, the control circuitry may obtain the information relating to the load of the power source in several ways. One of the most practical ways, requiring a minimal amount of extra components, is to determine the load by determining an input power and a highest mechanical output power of the power source. According to an aspect, the load may then be defined as a ratio between the input power and the highest mechanical output power. Before or in connection with the control circuitry receiving or retrieving the information relating to the load, the relevant parts of the information have to be determined. Thus, according to an aspect, the method 300 further comprises determining S37 the information relating to the load of the power source. The determination the information relating to the load of the power source comprises determining S37*a* an input power of the power source, and determining S37*b* a highest mechanical output power of the power source.

Figure 4:
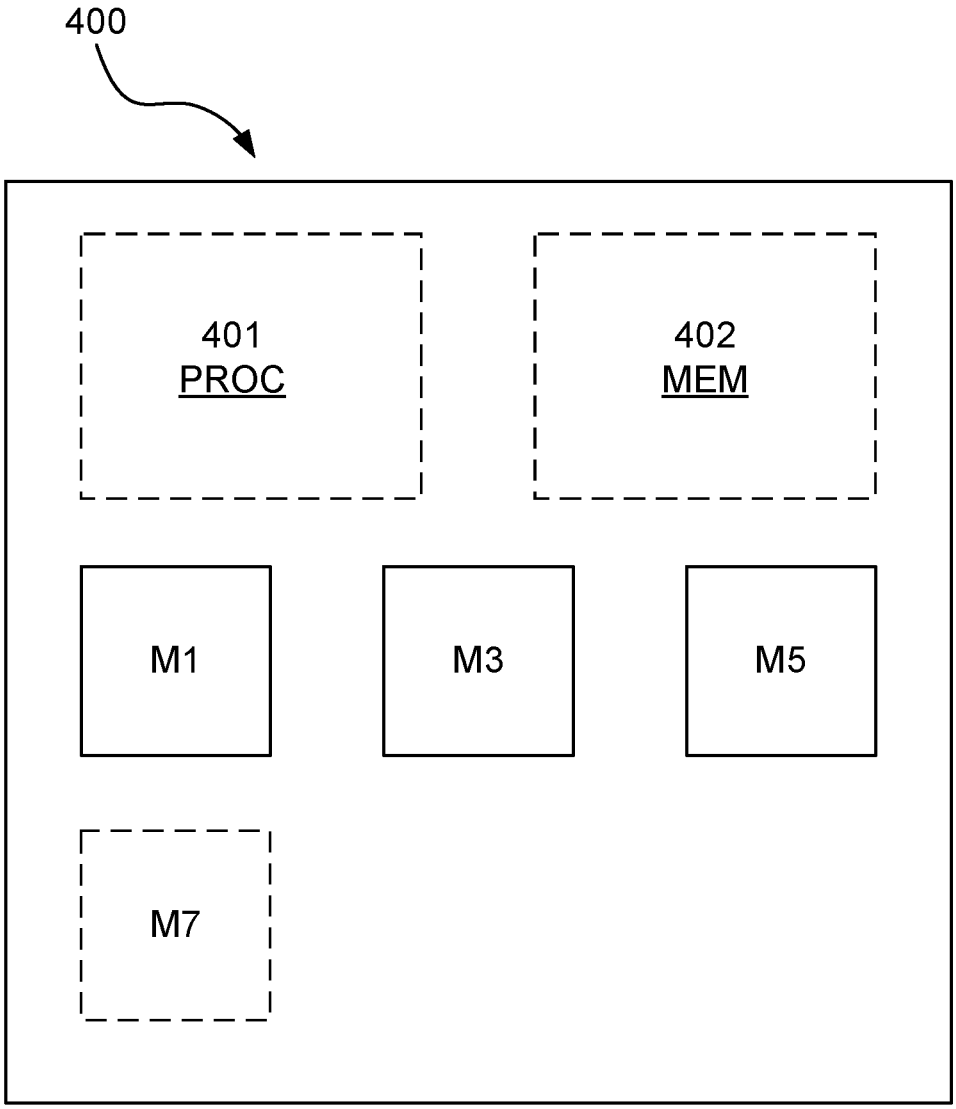
FIG. 4 illustrates a control circuitry of a breaker machine according to the present disclosure.

FIG. 4 illustrates a control circuitry 400 of a breaker machine according to the present disclosure. According to an aspect, the control circuitry 400 comprises a processor 401 arranged to perform the method steps disclosed in relation to FIG. 3. According to an aspect, the control circuitry 400 comprises a memory 402. According to a further aspect, the control circuitry 400 comprises an information receiving module M1 arranged to receive information relating to a load of the power source. According to an additional aspect, the control circuitry 400 comprises a selecting module M3 arranged to select a striking frequency based on the information relating to the load of the power source. According to a yet further aspect, the control circuitry 400 also comprises an applying module M5 arranged to apply the selected striking frequency by controlling an output from the power source. According to an aspect, the applying module M5 is further arranged to ramp a current striking frequency to the selected striking frequency based on a predetermined ramping scheme. According to an aspect, the control circuitry 400 further comprises an information determining module M7 arranged to determine the information relating to the load of the power source. According to an aspect, the information determining module is further arranged to determine an input power of the power source. According to an aspect, the information determining module is also arranged to determine a highest mechanical output power of the power source.

The invention claimed is:

1. A breaker machine comprising:

a power source, a tool holder configured to receive a tool, a power driven striking mechanism configured to strike a tip of the tool with a striking frequency on a hard surface, control circuitry configured to control an output from the power source, and a load detector configured to detect the load of the power source and transmit information relating to the detected load of the power source to the control circuitry, wherein the control circuitry is configured to receive the information relating to the load of the power source, wherein the control circuitry is further configured to select a striking frequency based on the information relating to the load of the power source and to apply the selected striking frequency by ramping a current striking frequency to the selected striking frequency based on a predetermined ramping scheme by controlling the output from the power source, wherein the predetermined ramping scheme comprises at least two different ramping rates when ramping the current striking frequency to the selected striking frequency, wherein the control circuitry is further configured to provide an idling striking frequency below 10 Hz.

2. The breaker machine according to claim 1, wherein the power source comprises an electric motor.

3. The breaker machine according to claim 1, wherein the control circuitry is programmable.

4. The breaker machine according to claim 3, wherein the load detector comprises a power analyzer configured to determine an input power to the power source.

5. The breaker machine according to claim 1, wherein the breaker machine comprises storage means having stored thereon information relating to a predetermined measure of a highest mechanical output power of the power source.

6. The breaker machine according to claim 1, wherein the breaker machine is configured to determine a load of the power source based on information relating to an input power to the power source and information relating to a predetermined measure of a highest mechanical output power of the power source.

7. A breaker machine comprising:

a power source, a tool holder configured to receive a tool, a power driven striking mechanism configured to strike a tip of the tool with a striking frequency on a hard surface, control circuitry configured to control an output from the power source, and a load detector configured to detect the load of the power source and transmit information relating to the detected load of the power source to the control circuitry, wherein the control circuitry is configured to receive the information relating to the load of the power source, wherein the control circuitry is further configured to select a striking frequency based on the information relating to the load of the power source and to apply the selected striking frequency by ramping a current striking frequency to the selected striking frequency based on a predetermined ramping scheme by controlling the output from the power source, wherein the control circuitry is programmable, and wherein the load detector comprises a multi-meter arranged to measure an input voltage, an input electric current and an efficiency measure of the power source separately.

8. A method performed in a control circuitry of a breaker machine comprising a power source, a tool holder configured to receive a tool and a power driven striking mechanism configured to strike a tip of the tool with a striking frequency on a hard surface, comprising the steps of:

receiving information relating to a load of the power source from a load detector arranged to detect the load of the power source, selecting a striking frequency based on the information relating to the load of the power source, and applying the selected striking frequency by ramping a current striking frequency to the selected striking frequency based on a predetermined ramping scheme for controlling an output from the power source, wherein the predetermined ramping scheme comprises at least two different ramping rates when ramping the current striking frequency to the selected striking frequency, wherein an idling striking frequency is provided below 10 Hz.

9. A non-transitory computer-readable storage medium comprising computer program code which, when executed, causes a control circuitry of a breaker machine to execute the method of claim 8.

* * * * *